US008746827B2

(12) United States Patent
Darling

(10) Patent No.: US 8,746,827 B2
(45) Date of Patent: Jun. 10, 2014

(54) INK JET APPARATUS

(75) Inventor: Douglas D. Darling, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 509 days.

(21) Appl. No.: 11/150,791

(22) Filed: Jun. 9, 2005

(65) Prior Publication Data

US 2006/0279593 A1 Dec. 14, 2006

(51) Int. Cl.
*B41J 29/38* (2006.01)

(52) U.S. Cl.
USPC ..... 347/11; 347/9; 347/10

(58) Field of Classification Search
USPC ..... 347/10, 11, 9, 5
See application file for complete search history.

(56) References Cited

U.S. PATENT DOCUMENTS 6,312,077 B1 * 11/2001 Araki ..... 347/11
2005/0093903 A1 5/2005 Darling

* cited by examiner

*Primary Examiner* — Lam S Nguyen
(74) *Attorney, Agent, or Firm* — Fay Sharpe LLP

(57) ABSTRACT

A drop emitting device that includes a drop generator and a drive signal waveform that includes in sequence a pulse of a first polarity, a first pulse of a second polarity, a delay interval, and a second pulse of the second polarity that includes a high frequency segment.

22 Claims, 3 Drawing Sheets

INK JET APPARATUS

BACKGROUND OF THE DISCLOSURE

The subject disclosure is generally directed to drop generating apparatus.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

A known ink jet drop generator structure employs an electromechanical transducer to displace ink from an ink chamber into a drop forming outlet passage, and it can be difficult to control drop velocity and/or drop mass.

DETAILED DESCRIPTION OF THE DISCLOSURE

Figure 1:
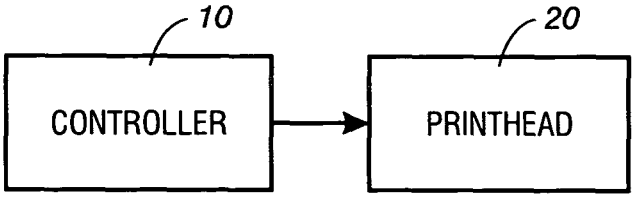
FIG. 1 is a schematic block diagram of an embodiment of a drop-on-demand drop emitting apparatus.

FIG. 1 is schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel.

Figure 2:
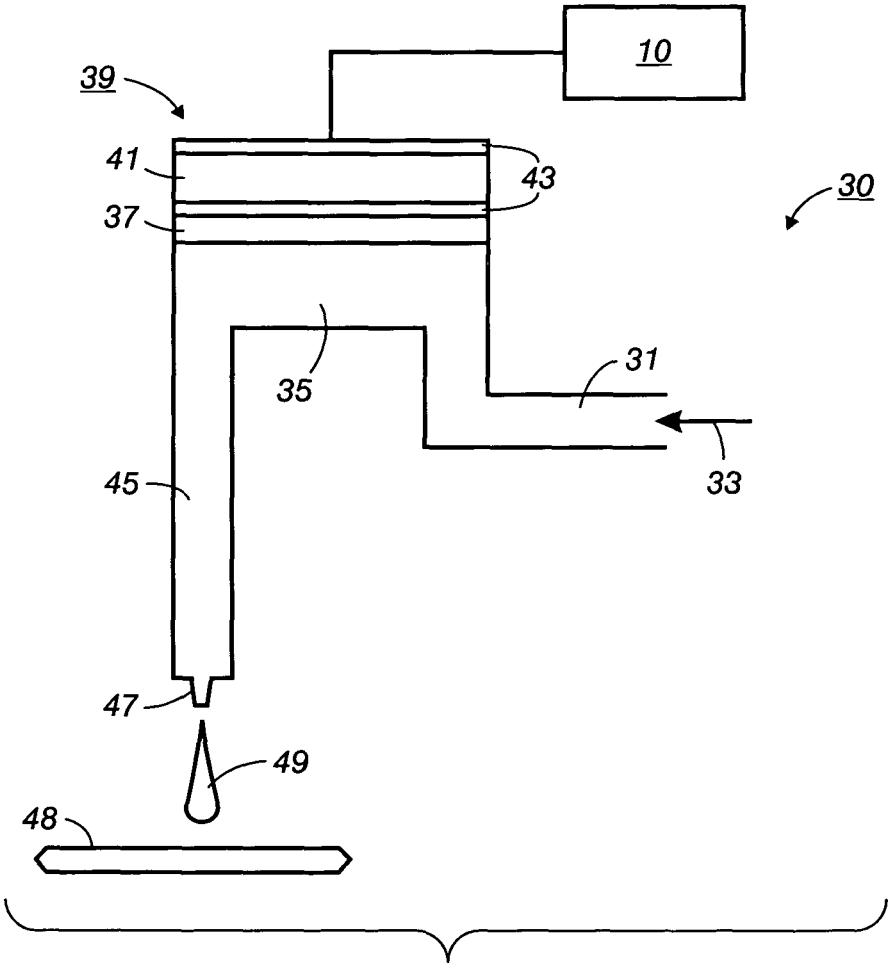
FIG. 2 is a schematic block diagram of an embodiment of a drop generator that can be employed in the drop emitting apparatus of FIG. 1.

FIG. 2 is a schematic block diagram of an embodiment of a drop generator 30 that can be employed in the printhead assembly 20 of the printing apparatus shown in FIG. 1. The drop generator 30 includes an inlet channel 31 that receives ink 33 from a manifold, reservoir or other ink containing structure. The ink 33 flows into a pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface, for example. The outlet channel 45 can include a nozzle or orifice 47.

The ink 33 can be melted or phase changed solid ink, and the electromechanical transducer 39 can be a piezoelectric transducer that is operated in a bending mode, for example.

Figure 3:
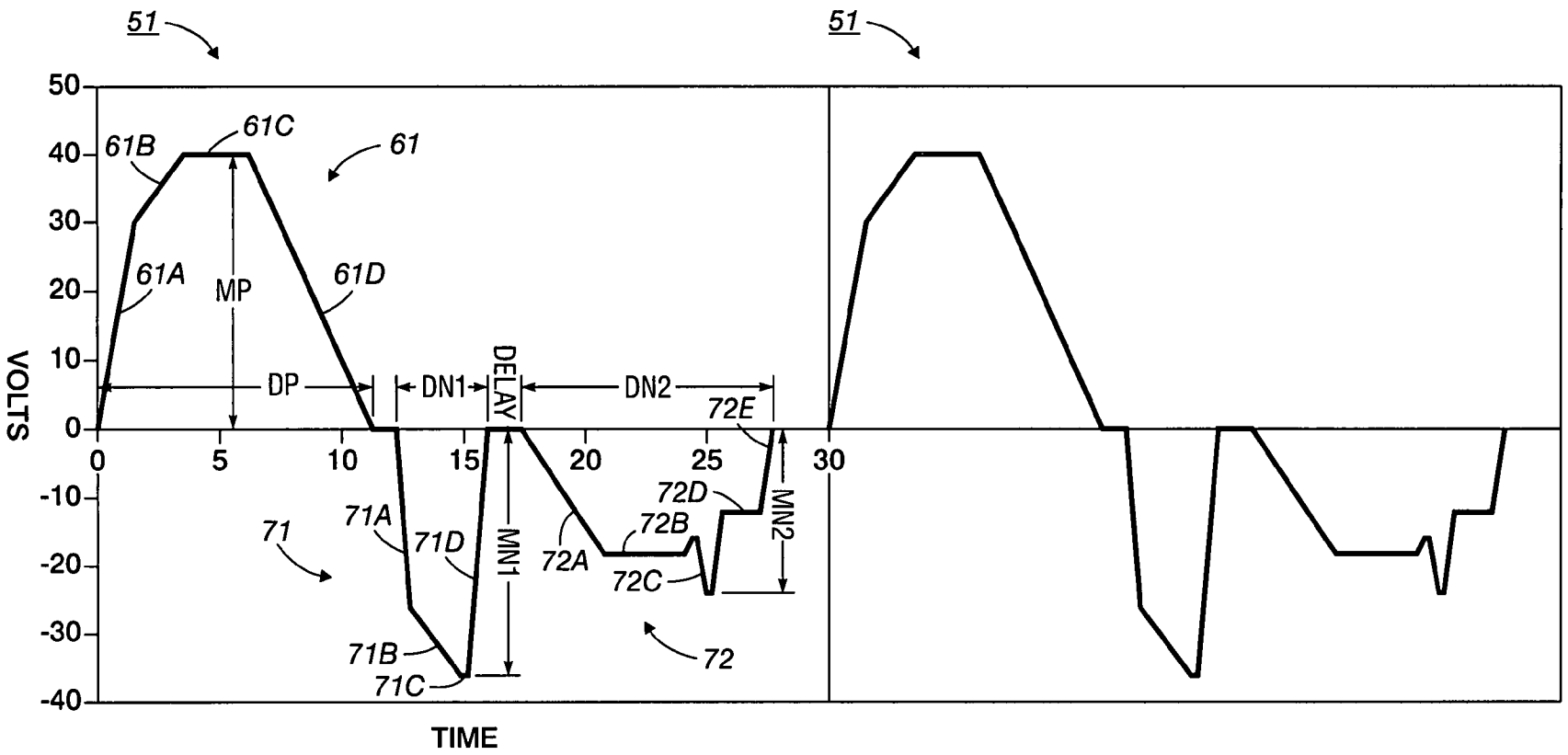
FIG. 3 is a schematic depiction of an embodiment of a drive signal that can be employed to drive the drop generator of FIG. 2.
Figure 4:
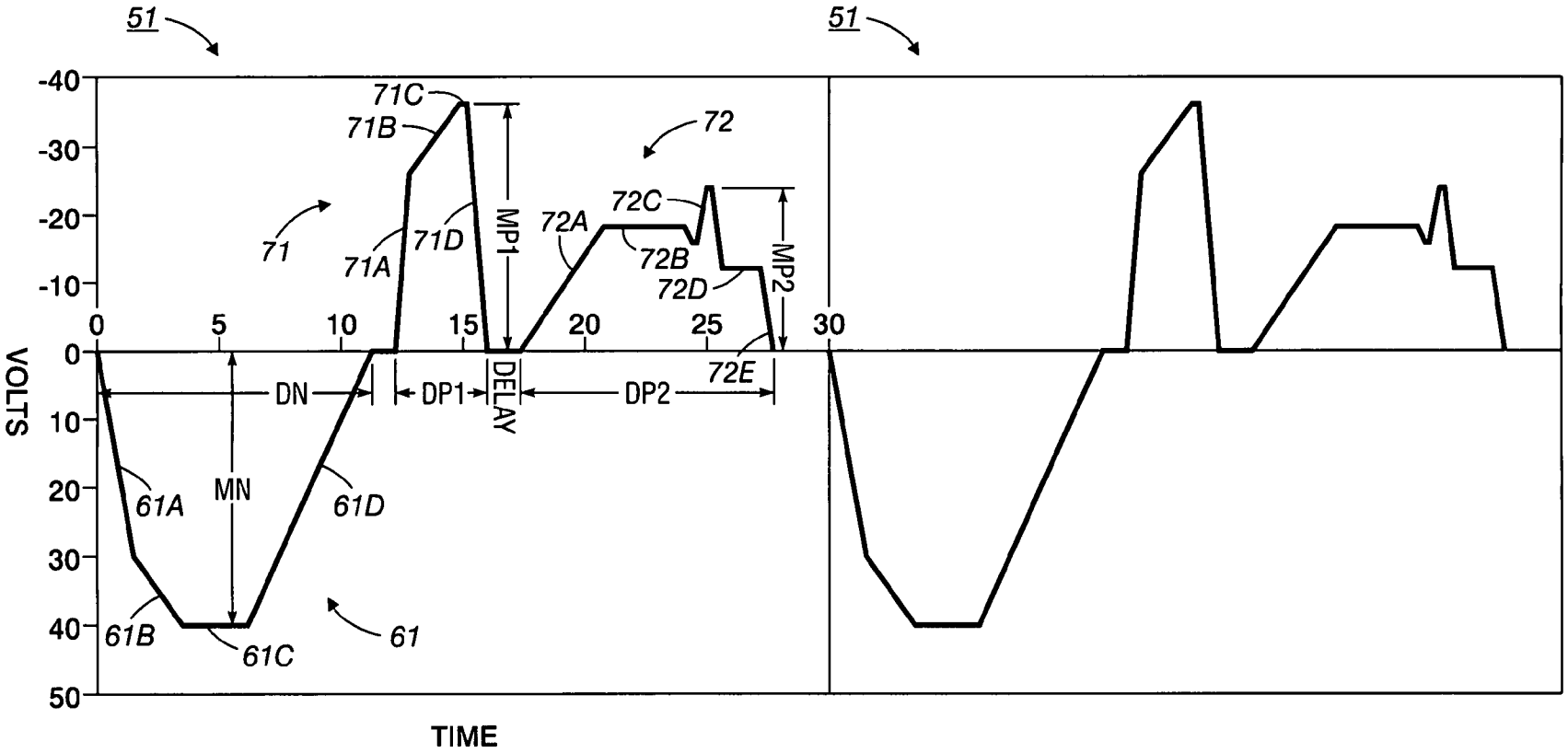
FIG. 4 is a schematic depiction of another embodiment of a drive signal that can be employed to drive the drop generator of FIG. 2.

FIGS. 3 and 4 are schematic diagrams of embodiments of a drive drop firing signal or waveform 51 that is provided to the printhead during a firing interval T to cause an ink drop to be emitted. The time varying drop firing waveform 51 is shaped or configured to actuate the electromechanical transducer such that the drop generator emits an ink drop. The duration of the waveform 51 can be less than the firing interval T. By way of illustrative example, the firing interval T can be in the range of about 100 microseconds to about 25 microseconds, such that the drop generator can be operated at a drop firing frequency in the range of about 10 KHz to about 40 KHz for the example wherein the firing interval T is substantially equal to the reciprocal of the drop firing frequency. The total duration of the waveform 51 can be in the range of about 20 microseconds to about 30 microseconds, for example.

By way of illustrative example, the drop firing waveform 51 can be a bi-polar voltage signal having in sequence a positive pulse component 61, a first negative pulse component 71, a DELAY, and a second negative pulse 72 component. The pulses are negative or positive relative to a reference such as zero volts. Each pulse is characterized by a pulse duration DP, DN1, DN2 which for convenience is measured between the pulse transition times (i.e., the transition from the reference and the transition to the reference). Each pulse is also characterized by a peak pulse magnitude MP, MN1, and MN2 which herein is a positive number.

The positive pulse 61 can have a duration DP in the range of about 10 microseconds to about 16 microseconds. The first negative pulse 71 can have a duration DN1 in the range of about 3 microseconds to about 7 microseconds. The second negative pulse 72 can have a duration DN2 in the range of about 7 microseconds to about 12 microseconds. In this manner, the positive pulse 61 can have a duration that is greater than the duration DN1 of the first negative pulse 71 and less than or greater than the duration DN2 of the second negative pulse 72. The duration DN2 of the second negative pulse 72 can be greater than the duration DN1 of the first negative pulse 71. The durations DN1, DN2 of the first and second negative pulses 71, 72 can be similar.

The positive pulse 61 can have a peak magnitude MP in the range of about 33 volts to about 47 volts. For example, the peak magnitude MP of the positive pulse 61 can be about 39 volts or less. The positive pulse 61 can include for example four segments: a first positive going segment 61A, a second positive going segment 61B, a substantially constant level segment 61C, and a negative going segment 61D. The first positive going segment 61A is steeper than the second positive going segment 61B.

The first negative pulse 71 can have a peak magnitude MN1 in the range of about 30 volts to about 47 volts. For example, the peak magnitude MN1 of the first negative pulse 71 can be about 35 volts or less. The first negative pulse 71 can have a peak magnitude MN1 that is less than the peak magnitude MP of the positive pulse 61. The first negative pulse 71 can include for example four segments: a first negative going segment 71A, a second negative going segment 71B, a substantially constant level segment 71C, and a positive going segment 71D. The first negative going segment 71A is steeper than the second negative going segment 71A. The substantially constant level segment 71C can be shorter than the substantially constant level segment 61C of the positive pulse 61.

The second negative pulse 72 can have a peak magnitude MN2 that is in the range of about 15 volts to about 47 volts. For example, the peak magnitude MN2 of the second negative pulse 72 can be about 22 volts or less. The second negative pulse 72 can have a peak magnitude MN2 that is less than the peak magnitude MP of the positive pulse 61 and is less than the peak magnitude MN1 of the first negative pulse 61. The second negative pulse 72 can be generally trapezoidal (FIG. 4), for example, and can include a first negative going segment 72A, a first substantially constant segment 72B, a high frequency sub-pulse 72C, a second substantially constant segment 72D, and a positive going segment 72E. The high frequency sub-pulse 72C includes in series a positive going segment, a negative going segment and a positive going segment. The high frequency sub-pulse 72C can have a frequency that is greater than about 75 KHz, and an amplitude of up to 15 volts relative to the substantially constant voltage segments 72B, 72D. The first and second substantially constant voltage segments 72B, 72D can be of different voltages.

In operation, the positive pulse 61 and the first negative pulse 71 cause a drop to be emitted by varying the volume of the pressure chamber 35 (FIG. 2). The second negative pulse 72 occurs after a drop is emitted and can function to reset the drop generator so that subsequent drops have substantially the same or greater mass and substantially the same velocity as the drop just emitted. The second negative pulse 72 is of the same polarity as the preceding first negative pulse 71, so that the final segment 72E can tend to pull the meniscus at the nozzle 47 inwardly to help prevent the meniscus from breaking. If the meniscus breaks and ink oozes out of the nozzle, the drop generator can fail to emit drops on subsequent firings.

The DELAY between the first negative pulse 71 and the second negative pulse 72 can be in the range of about 1 microsecond to about 4 microseconds.

The shape of the second negative pulse 72 can be selected such that (1) the correct amount of energy will be applied by the second negative pulse to cancel the residual energy that remains in the drop generator after a drop is emitted, (2) the second negative pulse will not itself fire a drop, and (3) the drop generator will not ingest an air bubble through the nozzle.

It is more generally contemplated that the waveform 51 comprises, in sequence, a first pulse having a first polarity, a second pulse having a second polarity, a delay, and a third pulse having the second polarity. FIG. 4 is a schematic diagram of an embodiment of a drive drop firing signal or waveform 51 that are of an opposite polarity from the waveform of FIG. 3. The waveform of FIG. 4 comprises a negative going pulse 61, a first positive going pulse 71, a DELAY, and a second positive going pulse 72. The durations DN, DP1, DP2 and magnitudes MN, MP1, MP2 of the pulses of the waveform of FIG. 4 can be substantially the same as the durations DP, DN1, DN2 and magnitudes MP, MN1, MN2 of corresponding pulses in the waveform of FIG. 3.

In the waveform of FIG. 4, the negative going pulse 61 can include for example four segments: a first negative going segment 61A, a second negative going segment 61B, a substantially constant level segment 61C, and a positive going segment 61D. The first negative going segment 61A is steeper than the second negative going segment 61B. The first positive pulse 71 can include for example four segments: a first positive going segment 71A, a second positive going segment 71B, a substantially constant level segment 71C, and a negative going segment 71D. The first positive going segment 71A is steeper than the second positive going segment 71A. The substantially constant level segment 71C can be shorter than the substantially constant level segment 61C of the negative pulse 61. The second positive pulse 72 can be generally trapezoidal and can include a first positive going segment 72A, a first substantially constant segment 72B, a high frequency segment 72C, a second substantially constant voltage segment 72D, and a negative going segment 72E. The first and second substantially constant voltage components can be of different voltages, while the high frequency segment 72C can have a frequency that is greater than about 75 KHz.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printing apparatus including a drop emitting device comprising:
- a drop generator;
- a controller emitting a drop firing waveform applied to the drop generator during a drop firing interval;
- the drop firing waveform including in sequence a pulse of a first polarity, a first pulse of a second polarity, a delay interval, and a second pulse of the second polarity, wherein the second polarity is opposite the first polarity;
- wherein the second pulse of the second polarity includes a first segment increasing in the direction of the second polarity, a first substantially constant segment, a high frequency sub-pulse having a frequency that is greater than about 75 KHz, a second substantially constant segment and a segment decreasing in the direction of the second polarity wherein the sub-pulse includes in series a segment decreasing in the direction of the second polarity, a segment increasing in the direction of the second polarity and a segment decreasing in the direction of the second polarity.

2. The drop emitting device of claim 1 wherein the second pulse of the second polarity further includes first and second substantially constant segments having different voltages.

3. The drop emitting device of claim 1 wherein the second pulse of the second polarity further includes first and second substantially constant segments having different voltages located on either side of the high frequency sub-pulse.

4. The drop emitting device of claim 1 wherein the drop generator comprises a piezo transducer.

5. The drop emitting device of claim 1 wherein the pulse of the first polarity and the first pulse of the second polarity are configured to cause a drop to be emitted.

6. The drop emitting device of claim 1 wherein:
- the pulse of the first polarity and the first pulse of the second polarity are configured to cause a drop to be emitted; and
- the second pulse of the second polarity is configured to dissipate residual energy remaining in the drop generator after a drop is emitted.

7. The drop emitting device of claim 1 wherein:
- the pulse of the first polarity and the first pulse of the second polarity are configured to cause a drop to be emitted; and
- the second pulse of the second polarity is configured to prevent breakage of a meniscus in the drop generator after a drop is emitted.

8. The drop emitting device of claim 1 wherein the delay is in the range of about 1 microsecond to about 4 microseconds.

9. The drop emitting device of claim 1 wherein the drop generator is operated at a drop firing frequency of at least about 10 KHz.

10. The drop emitting device of claim 1 wherein the drop generator is operated at a drop firing frequency in the range of about 10 KHz to about 40 KHz.

11. The drop emitting device of claim 1 wherein the first pulse of the second polarity has a duration that is less than a duration of the pulse of the first polarity.

12. The drop emitting device of claim 1 wherein the second pulse of the second polarity has a duration that is less than a duration of the pulse of the first polarity.

13. The drop emitting device of claim 1 wherein the second pulse of the second polarity has a duration that is greater than a duration of the pulse of the first polarity.

14. The drop emitting device of claim 1 wherein the second pulse of the second polarity has a duration that is greater than a duration of the first pulse of the second polarity.

15. The drop emitting device of claim 1 wherein the second pulse of the second polarity has a generally trapezoidal shape.

16. The drop emitting device of claim 1 wherein the pulse of the first polarity has a magnitude in the range of about 33 volts to about 47 volts.

17. The drop emitting device of claim 1 wherein the pulse of the first polarity has a magnitude of no more than about 39 volts.

18. The drop emitting device of claim 1 wherein the first pulse of the second polarity has a peak magnitude in the range of about 30 volts to about 47 volts.

19. The drop emitting device of claim 1 wherein the first pulse of the second polarity has a peak magnitude no more than about 35 volts.

20. The drop emitting device of claim 1 wherein the second pulse of the second polarity has a peak magnitude in the range of about 15 volts to about 47 volts.

21. The drop emitting device of claim 1 wherein the second pulse of the second polarity has a peak amplitude that is no more than about 22 volts.

22. The drop emitting device of claim 1 wherein the second pulse of the second polarity has a peak amplitude that is less than a peak amplitude of the first pulse of the second polarity.

* * * * *